United States Patent [19]

Forster et al.

[11] 4,370,100

[45] Jan. 25, 1983

[54] REGULATING DEVICES FOR HYDROSTATIC DRIVE UNITS

[75] Inventors: Franz Forster, Muhlbach; Harald Stein, Schaafheim, both of Fed. Rep. of Germany

[73] Assignee: Linde Aktiengesellschaft, Hollriegelskreuth, Fed. Rep. of Germany

[21] Appl. No.: 171,895

[22] Filed: Jul. 24, 1980

[30] Foreign Application Priority Data

Jul. 25, 1979 [DE] Fed. Rep. of Germany ..... 2930139

[51] Int. Cl.[3] ..... F04B 49/00

[52] U.S. Cl. ..... 417/218; 91/385; 91/506

[58] Field of Search ..... 417/218-222; 91/505, 506, 368, 385, 387

[56] References Cited

U.S. PATENT DOCUMENTS 3,669,570 6/1972 Himmler ..... 417/222

4,273,517 6/1981 Heyl ..... 417/222

FOREIGN PATENT DOCUMENTS 2810062 9/1979 Fed. Rep. of Germany ..... 417/218

*Primary Examiner*—Carlton R. Croyle

*Assistant Examiner*—Edward Look

*Attorney, Agent, or Firm*—Buell, Blenko, Ziesenheim & Beck

[57] ABSTRACT

A regulating device for a hydrostatic drive unit such as a hydropiston pump is provided with an adjusting piston designed as a differential piston, connected with the final control element of the drive unit and/or the pump and under pressure from both sides, and with a control valve controlling the pressure exerted on the adjusting piston in the pressure spaces in front of the end faces and with a control pressure gauge piston arranged in a sliding manner in the housing and on which the working pressure of the drive unit and/or feed pressure of the pump is exerted, and which lies against a lever, which is connected through a flexible coupling with the adjusting piston and is supported on this latter and is forced against it by a spring and actuates the control valve, in which case the control valve is located in the adjusting piston crosswise to its longitudinal axis, characterized in that the lever is designed as an angle lever and that the spring is located in the adjusting piston and lies against the section of the angle lever extending approximately crosswise to the longitudinal axis of the adjusting piston and is designed as a pressure spring, whose longitudinal axis runs parallel to that of the adjusting piston.

8 Claims, 6 Drawing Figures

REGULATING DEVICES FOR HYDROSTATIC DRIVE UNITS

Figure 1:
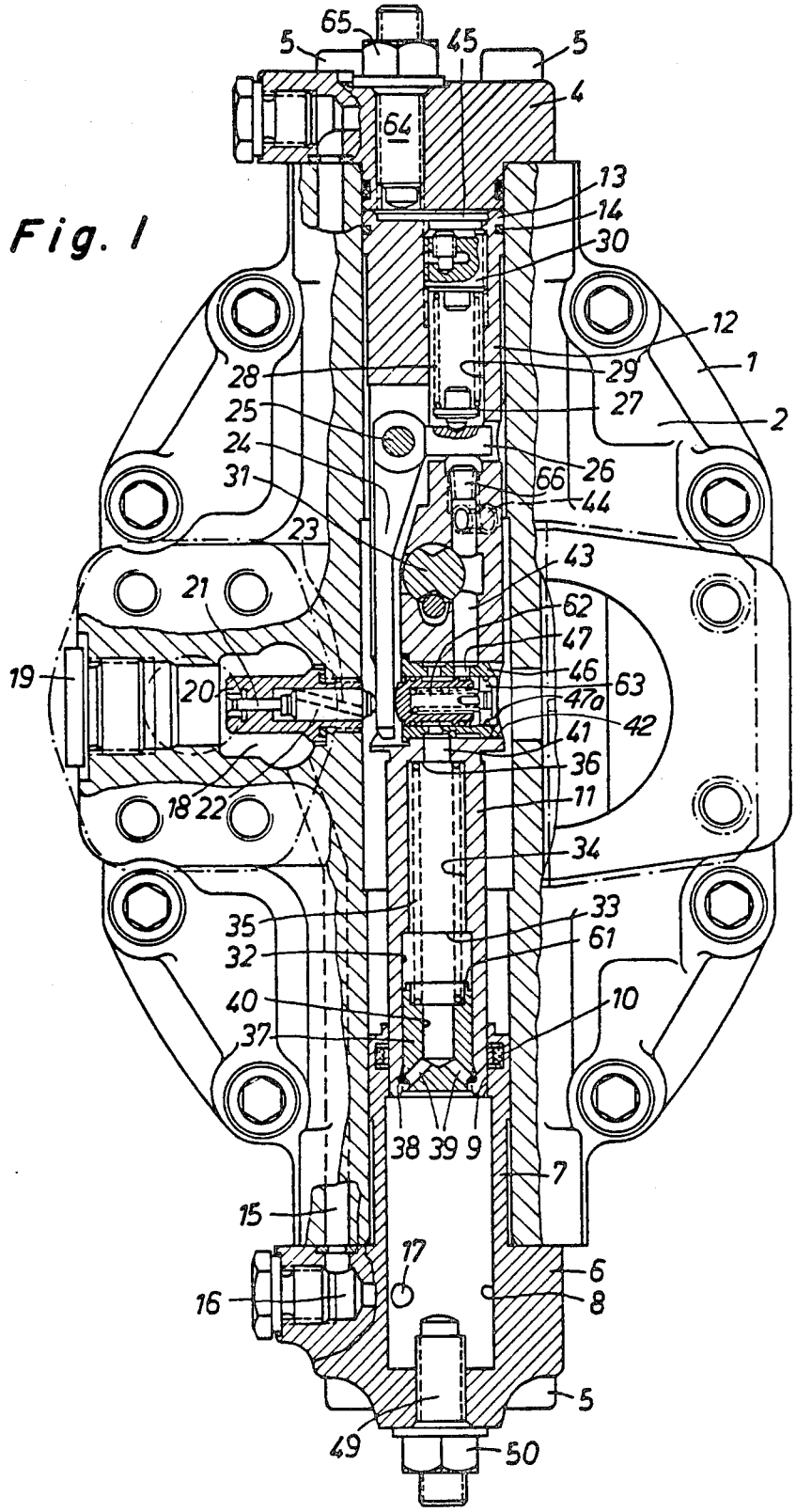

This invention relates to regulating devices for hydrostatic drive units and particularly to regulating devices for hydrostatic piston pumps such as disclosed in German Patent Application No. P 28 10 062.1. In the regulating means disclosed in the aforesaid application, a lever, which transfers the force produced by the control pressure to a regulating spring, is designed as a rectilinear lever extending approximately parallel to the longitudinal extension of the adjusting piston and both the control valve and the regulating spring are located in transverse holes in the adjusting piston. This has the disadvantage that little space is available for the regulating spring and that the adjusting piston must be removed from the regulating device in order to change its pretensioning for resetting the abutment support of the regulating spring.

A control and regulating device for a hydrostatic piston pump is, of course, also known in which the lever is designed as an angle lever. In this case, the lever section extending approximately parallel to the longitudinal extension of the adjusting piston runs in a space in front of the one front end of the piston, i.e., in a space in which the pressure acts on the adjusting piston. As a result, this adjustment pressure also acts against the control pressure on the piston on which the control pressure is exerted. In order to eliminate this disadvantage, constructive measures are required in the familiar device, in which two pistons are provided, which lie against each other and are connected with each other and each acts directly against one of the two regulating springs. An additional spring, working together with the regulating springs is located outside of the control and regulating device and is connected with the valve slide that is located in a longitudinal hole of the adjusting piston by means of a tie rod (CH-PS No. 501,835). This design is quite expensive, requires a large pressure space in which the lever is capable of being displaced in front of the one front face of the adjusting piston and requires many relatively expensive structural components.

The present invention provides a regulating device for a hydrostatic drive unit and particularly a hydropiston pump with an adjusting piston designed as a differential piston connected with the final control element of the drive unit and/or the pump and under pressure from both sides and with a control valve controlling the pressure exerted on the adjusting piston in the pressure spaces in front of the end faces and with a control pressure gauge piston arranged in a sliding manner in the housing and on which the working pressure of the drive unit and/or feed pressure of the pump is exerted and which lies against a lever which is connected through a flexible coupling with the adjusting piston and is supported on this latter and is forced against it by a spring and actuates the control valve in which case the control valve is located in the adjusting piston crosswise to its longitudinal axis in accordance with German Patent Application No. P 28 10 062.1 characterized in that the lever is designed as an angle lever and that the spring is located in the adjusting piston and lies against the section of the angle lever extending approximately crosswise to the longitudinal axis of the adjusting piston and is designed as a pressure spring whose longitudinal axis runs parallel to that of the adjusting piston.

This invention can be produced with little cost and the abutment support of the regulating spring in the adjusting piston is arranged such that an adjustment of the spring tension is possible without having to disassemble the adjusting piston.

A particularly advantageous arrangement of the invention as described above is one in which the spring is located in a longitudinal hole of the adjusting piston and is supported against a closure element in this hole, the position of which is adjustable in the axial direction in the hole from the front end of the adjusting piston. The closure element serves to seal off the space in front of the front face of the piston against the pressureless space in which the spring and the angle lever are located and also serves as an abutment support for the spring. This closure body is supported by threads in the longitudinal hole and is thus readily adjustable in position in the longitudinal hole and can be locked in position in the usual manner by a lock nut or a stay element. This adjustment can be readily effected from the front face of the adjusting piston without having to dismantle the adjusting piston. Thus, the spring tension and also the regulating characteristics of the regulator can be varied and set at the desired capacity quite readily by varying the position of this closure element.

It is, accordingly, an object of this invention to provide a regulating device for a hydrostatic drive unit which is relatively small in size as compared to prior art devices and yet still allows sufficient space for a governing spring of adequate size.

It is a further object to provide a device in which pretensioning of the governing spring can be adjusted by simply removing a cover without need to pull the adjusting piston from the operating cylinder.

In the foregoing specification certain objects, purposes and advantages of this invention have been set out. Other objects, purposes and advantages of this invention will be apparent from a consideration of the following description and the accompanying drawings in which:

FIG. 1 is a section through a regulator according to this invention adapted for a swivel carriage pump.

FIGS. *2a–2e* are fragmentary isometric views of methods of attaching the control slide element to the lever arm of the regulator of this invention.

A regulator according to this invention adapted for a swivel carriage pump is shown in cross section.

The shell bottom 1 is the closure section of a housing of a swivel carriage pump (not shown in the drawing) in which case the guideway for the swivel carriage (not shown) is located on the side of the shell bottom 1 facing away. A longitudinal hole 3 is provided in a projecting portion 2 of the shell bottom 1; it is closed off on one side by a cover 4 which is connected to portion 2 by the bolts 5. On the side opposite the cover 4 a closure section 6 is connected with portion 2 by bolts 5 in which case this closure section 6 has a sleeve section 7 that projects into the hole 3.

A hole 8 is provided in the closure section 6; it is designed with a cylindrical bore 9 in the front section in which a slider seal 10 is located and in which the section 11 of smaller diameter of the adjusting piston slides in a sealed manner. The section 11 is joined solidly to the section 12 of larger diameter of the adjusting piston which slides directly in the hole 3 with its head section 13 in which case a sealing ring 14 is provided for sealing.

A channel (not shown in the drawing) is effected in the shell bottom 1; it connects with the feed pressure channel of the swivel carriage. This channel is connected with a hole 15 which is connected with a transverse hole 16 which is connected through hole 17 with the internal space of the hole 8.

The hole 15 is also connected with the space 18 which is closed off by a plug 19. A housing component 20 which is bolted in a sealed manner into the section 2 projects into the space 18. A cylindrical hole in which the control-pressure piston 21 is capable of being displaced is provided in the component 20. This latter piston rests against a support element 22 which has a groove 23 so that the same pressure always prevails on both faces of this support element 22. The support element 22 lies against an angle lever 24 which can be supported in a swivelling manner in the adjusting piston 11, 12 by means of a joint bolt 25. The spring plate 27 lies against the second arm 26 of the angle lever 25, 26 against which the spring 28 that is located in a hole 29 of the adjusting piston 11, 12 is supported and is supported against an element 30 that is screwed by means of threads into a threaded portion of the longitudinal hole 29 and can be fastened in a preselected position.

The adjusting piston 11, 12 is joined by a cross-bolt 31 with the swivel carriage (not shown in the drawing).

In the section 11 of the adjusting piston 11, 12 there is a longitudinal passage 32, which passes into a longitudinal passage 34 of smaller diameter at a shoulder 33. A spring 35 is located in this passage 32, 34; it is supported on one side against a shoulder 36 and on the other side against a spring plate element 37 that lies against a Seeger ring 38 and in which two holes 39 converge into one hole 40 and which has a front surface 61.

A hole 41 extends axially from the passages 34 to a cross hole 42 intermediate the ends of piston 11. Shifted radially of passage 34 with regard to the hole 41, a hole 43 longitudinally connects with the cross hole 42; the hole 43 is connected with the space 45 in front of the front face of the adjusting piston 12, 13 through a cross hole 44 in a manner not shown in the drawing. A valve body 46, in which a valve slide 47 is capable of being displaced and which lies against the angle lever 24 and is provided with annular tee-slots 47*a*, is inserted into the cross hole 42; this valve element 46 has holes that are connected with the holes 41 and 43. Depending on the position of the slide body 47, the annular tee-slot 47*a* forms a connection between the channels 41 and 43 or connects by means of another recess the channel 43 with the space in front of the front face of the valve slide 47 in the hole 42.

A stop screw 49, which is adjustable in any position by means of a lock nut 50, is screwed into the closure section 6.

The mode of operation is as follows: The feed pressure of the pump acts in the channel 15 and thus in space 18 and acts in the latter on the front face of the control piston 21. The force resulting from this pressure effect on the face acts on the intermediate support element 22 and, through this latter, on the long arm of the lever 24. This force acts against the force of spring 28 on the other side. If the product of the force exerted by the pressure on the front face of the control piston 21 times the correlated lever arm is greater than the product of the force of spring 28 times the correlated lever arm, the spring 28 is pressed back. Thus, the lever 24 is pressed to the right according to the drawing and thus presses on the control slide element 47, which by its annular tee-slot produces a connection between the hole 41 and the hole 43. Pressure medium thus flows from channel 15 through the holes 16 and 17 and the hole 8, the holes 39, the hole 40 and the hole 34, the hole 41 and the holes 43 and 44 into the space 45 in front of the large front face of adjusting piston 11, 12. Because the same pressure acts in front of the large front face of the adjusting piston 11, 12 as in front of the small front face of the adjusting piston section 11, the adjusting piston moves downward according to the drawing. The lever arm on which the force of the control piston 21 acts is thus diminished until the force of spring 28 is capable of pressing back the control piston 21 with the result that the control slide element 47 returns to the position shown in the drawing under the action of the supplementary spring 62 and shuts off the connection between the holes 41 and 43. The adjusting piston has thus reached a new equilibrium position.

Now, if the pressure in the channel 15 and thus in the space 18 decreases, the product of the force of spring 28 times the lever arm exceeds the product of the force on the control piston 21 times the correlated lever arm so that the angle lever 24, 26 turns clockwise, with the result that the control valve element 47 is shifted to the left under the pressure of spring 62 and connects the hole 43 with hole 42, which is connected with the pressure-relieved inner space of the pump housing. Pressure medium is thus released from the space 45 and the adjusting piston moves upward according to the drawing under the force of the pressure acting on the front face of the adjusting piston section 11 in the hole 8.

If the pump is swung into the vicinity of the zero feed position, the spring plate element 37 lies on the front face of the stop screw 49 and compresses the spring 35 downward with an additional movement of the adjusting piston 11, 12, so that the spring 35, which is thus supported on the housing through the spring plate element 37 and the stop screw 49, exerts a force on the adjusting piston 11, 12 such that the pump is swung out of the zero delivery position.

In extreme cases the spring plate element 37 may be pressed so deeply into the hole 32 that the front face 61 of the spring plate element 37 comes to lie against the shoulder 33. The minimum swing position for the pump is thus simultaneously defined. The minimum swing position can thus be set by adjusting the stop screw 49.

Even if the pump delivers only a very small stream or none at all in the position and thus builds up no delivery pressure, the pump can be swung out of the zero delivery position or a position adjacent to it by the action of spring 35.

The spring 62 is supported against a spring plate 63 that is fastened in the hole 42. The plug 66 closes off the hole 43. The stop adjusting screw 64 limits the maximum stroke of the regulator and thus the maximum swing position. The stop adjusting screw 64 can be fastened in position by means of the nut 65.

Figure 2A:
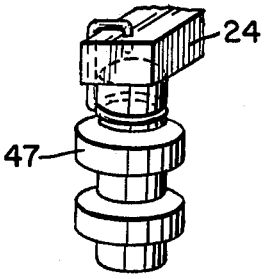
Figure 2B:
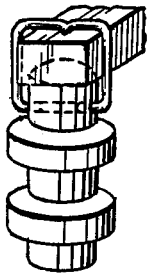
Figure 2C:
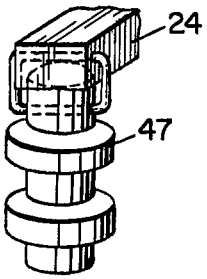
Figure 2D:
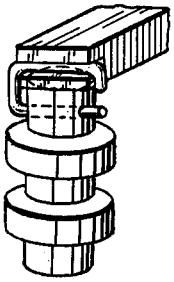
Figure 2E:
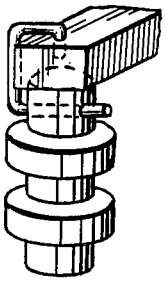

In FIGS. 2*a* and 2*e* we have illustrated several methods of attaching the valve 47 to lever arm 24 to eliminate the need for spring 62. In such structure the lever arm 24 raises or depresses valve 47 under the influence of spring 28 without the need for spring 62 to force the valve to follow arm 24.

In the foregoing specification we have illustrated and described certain preferred practices and embodiments of this invention, however, it will be understood that this invention may be otherwise embodied within the scope of the following claims.

We claim:

1. A regulating device for a hydrostatic drive unit such as a hydropiston pump with a housing having therein an adjusting piston designed as a differential piston having end faces of different areas connected with the final control element of at least one of a variable displacement motor and a variable displacement pump whereby the stroke of said pump or motor is varied and under pressure from both sides and with a control valve in said piston controlling the pressures exerted on the adjusting piston in the pressure spaces in front of the end faces the improvement comprising at least one control pressure metering piston arranged in a sliding manner in the housing and on which the working pressure of at least one of the drive unit and feed pressure of the pump is exerted, a lever which lies against said metering piston and which is connected through a flexible coupling with the adjusting piston and is supported on this latter, a spring forcing said lever against the piston and actuating the control valve, said control valve being located in the adjusting piston crosswise to its longitudinal axis, said lever being in the form of an angle lever, said spring being located in the adjusting piston and lying against the section of the angle lever extending approximately crosswise to the longitudinal axis of the adjusting piston and designed as a pressure spring, whose longitudinal axis runs parallel to that of the adjusting piston.

2. Regulating device according to claim 1, characterized in that the spring is located in a longitudinal hole of the adjusting piston and is supported against a closure element in this hole, the position of which is adjustable in the axial direction in the hole from larger end of the adjusting piston.

3. Regulating device according to claim 1 or 2 characterized in that the smaller of the two end faces of different area includes a piston movable coaxially in a bore in said piston, second spring means urging said piston axially to form a normal part of said end face and adjustable stop means engaging said piston as the differential piston approaches the end of its travel under the urging of fluid pressure to lead said spring to urge the adjusting position toward the end of the housing having the larger end of the adjusting piston.

4. A regulating device for a hydrostatic drive unit such as a hydropiston pump comprising a housing, a longitudinal bore in said housing having a larger effective bore diameter at one end than at the other, a piston movable in said bore, said piston having one end of larger diameter movable lengthwise in the larger bore diameter and the other end of smaller diameter movable lengthwise in the other bore thereby forming a differential piston, a final control element connected to at least one of a variable displacement motor and a variable displacement pump whereby the displacement may be varied, connecting means connecting said final control element and said piston, means delivering pressure fluid to both ends of said piston, a control valve in said piston controlling the relative pressures exerted on the ends of said piston, a control pressure piston in the housing transverse to the bore receiving pressure from at least one of the drive unit and feed pump, a lever arm pivoted at one end in a recess in said piston and extending longitudinally within the same, said lever arm lying between said control valve and control pressure piston and being urged toward the control valve by said control pressure piston, said lever arm being one side of a bell crank lever, a spring in said piston bearing on the end of said bell crank opposite the said lever arm to urge the same away from the control valve toward the control pressure piston.

5. A regulating device as claimed in claim 4 wherein the spring is mounted in a longitudinal hole in the piston and the adjusting means are provided in said hole for adjusting the spring force on the bell crank arm.

6. A regulating device as claimed in claim 4 or 5 wherein the control valve is mounted in a transverse passage in the piston adjacent the end of the lever arm.

7. A regulating device as claimed in claim 6 wherein the control valve is mounted in a transverse passage in the piston adjacent the end of the lever arm and is pivotally connected to the end of said lever arm.

8. A regulating device as claimed in claim 6 wherein the control valve is resiliently mounted in said passage to move transversely of the piston to follow the movement of the lever arm.

* * * * *